US009528699B2

(12) United States Patent
Kuipers

(10) Patent No.: US 9,528,699 B2
(45) Date of Patent: Dec. 27, 2016

(54) PREMIX GAS BURNER WITH TEMPERATURE MEASUREMENT

(75) Inventor: Toby Kuipers, Groningen (NL)

(73) Assignee: BEKAERT COMBUSTION TECHNOLOGY B.V., Assen (NL)

( * ) Notice: Subject to any disclaimer, the term of this patent is extended or adjusted under 35 U.S.C. 154(b) by 535 days.

(21) Appl. No.: 14/114,800

(22) PCT Filed: Apr. 24, 2012

(86) PCT No.: PCT/EP2012/057430
§ 371 (c)(1),
(2), (4) Date: Oct. 30, 2013

(87) PCT Pub. No.: WO2012/152571
PCT Pub. Date: Nov. 15, 2012

(65) Prior Publication Data

US 2014/0080074 A1 Mar. 20, 2014

(30) Foreign Application Priority Data

May 6, 2011 (EP) ..... 11165054.5

(51) Int. Cl.
*F23D 14/14* (2006.01)
*F23D 14/02* (2006.01)
*F23N 5/10* (2006.01)

(52) U.S. Cl.
CPC ..... *F23D 14/14* (2013.01); *F23D 14/02* (2013.01); *F23N 5/10* (2013.01);
(Continued)

(58) Field of Classification Search
CPC ..... F23D 14/12; F23D 14/14; F23D 14/125; F23D 14/145; F23D 14/16; F23D 14/18; F23D 2203/1023; F23D 2212/103; F23D 2208/10
(Continued)

(56) References Cited

U.S. PATENT DOCUMENTS 2,050,298 A 8/1936 Everett
2,482,238 A * 9/1949 Betz ..... F23Q 9/00 136/218
(Continued)

FOREIGN PATENT DOCUMENTS

DE 1 529 165 A1 12/1969
DE 41 12 449 A1 10/1991
(Continued)

OTHER PUBLICATIONS

KR 732937 B1—English machine translation.*
International Search Report in PCT/EP2012/057430, Jun. 20, 2012.

*Primary Examiner* — Jorge Pereiro
(74) *Attorney, Agent, or Firm* — Bacon & Thomas, PLLC

(57) ABSTRACT

A premix gas burner comprises a burner deck which comprises a fiber based substrate and a perforated plate or a screen supporting the fiber based burner substrate. The premix gas burner further comprises at least two contact wires that are forming a thermocouple. The contact wires are directly or indirectly fixed to the burner deck to measure a temperature of the burner deck when the premix gas burner is in operation. The fiber based substrate is locally at least partly connected directly or indirectly to the perforated plate or the screen in the region where the contact wires of the thermocouple are directly or indirectly fixed to the burner deck.

13 Claims, 6 Drawing Sheets

(52) U.S. Cl.
CPC .... *F23D 2203/106* (2013.01); *F23D 2208/00* (2013.01); *F23D 2900/00012* (2013.01)

(58) Field of Classification Search
USPC ..... 431/326–329
See application file for complete search history.

(56) References Cited

U.S. PATENT DOCUMENTS 2,710,055 A * 6/1955 Betz ..... F23D 14/725 136/218
3,107,720 A * 10/1963 Swinderen ..... F23C 99/00 431/329
3,277,564 A 10/1966 Webber et al.
3,321,001 A 5/1967 Vezzoli
3,394,213 A 7/1968 Roberts et al.
4,290,746 A * 9/1981 Smith ..... F23D 14/16 431/264
4,326,843 A * 4/1982 Smith ..... F23D 14/16 361/253
4,589,843 A * 5/1986 Smith ..... F23D 14/12 266/102
4,604,054 A * 8/1986 Smith ..... B23K 1/0053 431/328
4,930,199 A 6/1990 Yanagisawa
5,046,944 A * 9/1991 Smith ..... B31F 1/285 431/326
5,393,222 A * 2/1995 Sutton ..... F23N 5/10 431/328
5,409,375 A * 4/1995 Butcher ..... F23D 14/16 431/328
5,441,402 A * 8/1995 Reuther ..... F23D 14/02 431/328
5,865,616 A * 2/1999 George ..... F23D 14/02 239/553.3
8,353,627 B2 * 1/2013 Dotti ..... F23D 14/725 374/141
2001/0051320 A1 12/2001 Lasagni et al.
2003/0129557 A1 7/2003 Chapman
2011/0044868 A1 * 2/2011 Lee ..... C01B 3/384 422/626

FOREIGN PATENT DOCUMENTS

EP 1 039 220 A1 9/2000
EP 2 180 253 A1 4/2010
GB 2 270 748 A 3/1994
GB 2 456 861 A 7/2009
KR 732937 B1 * 6/2007 ..... F23D 14/12
WO 93/18342 A1 9/1993

* cited by examiner

PREMIX GAS BURNER WITH TEMPERATURE MEASUREMENT

BACKGROUND OF THE INVENTION

Technical Field

The present invention relates to a premix gas burner for operation in blue flame mode that is having a burner deck comprising a fiber based substrate and a screen or perforated plate supporting the fiber based substrate. The premix gas burner is further comprising contact wires forming a thermocouple fixed to the burner deck.

Background Art

Premix gas burner with operation in blue flame mode are known. The gas premix is burnt on a burner substrate and blue coloured flames are visible. The flue gas is containing the caloric value and will transfer its energy onto another medium, e.g. through a heat exchanger to water in a water heater. A different type of burners are radiation burners that operate in red flame mode to transfer their energy via radiation. Both types of burners (for operation in blue flame mode or for operation in red flame mode) are different in construction in order to be optimized for their mode of operation.

One way to control the combustion of a premix gas burner for operation in blue flame mode makes use of a measurement of a temperature at or on the burner deck.

GB 2 270 748 discloses a gas burner that is provided with a thermocouple for sensing the temperature of the surface of the burner, the burner deck may have a metallic perforated plate or a ceramic burner. The thermocouple is fixed to the underside (=non-combustion side) of the burner deck.

EP 1 039 220 discloses a premix gas burner that is having a perforated plate diffuser to which one or more thermocouples are attached.

EP 2 180 253 is describing prior art in which thermocouples are welded to the inner (=gas supply) side or outer (=combustion) side of a burner. Furthermore, EP 2 180 253 is disclosing a temperature sensor for a gas premix burner. The temperature sensor comprises two metal wires implementing a thermocouple, a protection sheath receiving the two metal wires, and a head in metal material having a front side intended to be facing the environment, the temperature of which is intended to be measured, and a rear side opposite the front side, in which the two metal wires are connected in a thermal exchange relationship to the head rear side, and the head comprises a front portion connectable to a burner wall of the burner so that the thermocouple is connectable to the burner by means of said metal head. The temperature sensor is used for gas premix burners having a perforated plate as burner deck.

It is a problem of the temperature measurement systems as known in the art (as described in GB 2 270 748, EP 1 039 220, in the prior art part as well as in the disclosing part of EP 2 180 253) that these temperature measurement systems do not result in reliable temperature results when a fiber based substrate supported by a screen or by a perforated plate is used as burner deck in gas premix burners.

SUMMARY OF THE INVENTION

It is the object of the invention to overcome the drawbacks of the prior art. It is a specific object of the invention to provide a gas premix burner for operation in blue flame mode that is having a fiber based substrate supported by a screen or perforated plate as burner deck; with a temperature measurement system that is providing reliable and reproducible temperature values.

A first aspect of the invention is a premix gas burner for operation in blue flame mode. The burner deck of the premix gas burner comprises a fiber based substrate and a perforated plate or a screen supporting the fiber based burner substrate; and at least two contact wires forming a thermocouple. The contact wires are directly or indirectly fixed to the burner deck to measure the temperature of the burner deck when the premix gas burner is in operation. With measurement of the temperature of the burner deck is meant that a temperature is measured representative for the temperature of a location of the burner deck; and wherein the measured temperature is reproducible. The fiber based substrate is locally at least partly connected directly or indirectly to the perforated plate or the screen in the region where the contact wires of the thermocouple are directly or indirectly fixed to the burner deck. The local at least partly direct or indirect connection of the fiber based substrate to the perforated plate or screen in the region where the contact wires of the thermocouple are directly or indirectly fixed to the burner deck has shown to stabilize the combustion in that region, resulting in a reliable and reproducible temperature measurement with the thermocouple.

The contact wires can be directly or indirectly fixed to the burner deck. With "directly fixed to the burner deck" is meant that the contact wires are in direct contact with the burner deck (meaning with the fiber based substrate or with the perforated plate or the screen supporting the fiber based burner substrate) and fixed to the burner deck (meaning to the fiber based substrate or to the perforated plate or the screen supporting the fiber based burner substrate). With "indirectly fixed to the burner deck" is meant that the contact wires are fixed to an additional member which is itself fixed to the burner deck (meaning to the fiber based substrate or to the perforated plate or the screen supporting the fiber based burner substrate, or to both).

With "the fiber based substrate is directly connected to the perforated plate or the screen" is meant that there is a direct contact and a direct connection between the fiber based substrate and the perforated plate or screen in the region where the contact wires of the thermocouple are directly or indirectly fixed to the burner deck. To this end, several techniques are available, the fiber based substrate can be welded, glued (using a temperature resistant glue, e.g. a ceramic glue), stapled, riveted, stitched or clamped to the perforated plate or screen.

With "the fiber based substrate is indirectly connected to the perforated plate or the screen" is meant that the fiber based substrate is itself connected to another element (e.g. a plate structure) which is itself connected to the perforated plate or screen supporting the fiber based substrate. An example is where the fiber based substrate is connected to an additional plate element which is locally positioned between the fiber based substrate and the perforated plate or screen supporting the fiber based substrate; with the additional plate element itself connected to the perforated plate or screen.

In a preferred execution of the invention, the at least partly connection of the fiber based substrate in the region where the contact wires of the thermocouple are directly or indirectly fixed to the burner deck, is within an area defined by a circle with diameter of 50 mm around the projection of the centerpoint of the contact wire connections to the burner deck.

Preferably, the at least partly connections of the fiber based substrate in the region where the contact wires of the thermocouple(s) are directly or indirectly fixed to the burner deck, are within an area defined by a circle with diameter of 24 mm around the projection of the centerpoint of the thermocouple(s) onto the burner deck. More preferably, the at least partly connections of the fiber based substrate in the region where the contact wires of the thermocouple are directly or indirectly fixed to the burner deck, are within an area defined by a circle with diameter of 15 mm around the projection of the centerpoint of the thermocouple(s) onto the burner deck. Most preferably, the at least partly connections of the fiber based substrate in the region where the contact wires of the thermocouple(s) are directly or indirectly fixed to the burner deck, are within an area defined by a circle with diameter of 10 mm around the projection of the centerpoint of the thermocouple(s) onto the burner deck.

With the fiber based substrate is locally "at least partly" connected in the region where the contact wires of the thermocouple directly or indirectly fixed to the burner deck; is meant that the direct or indirect fixation or connection of the fiber based burner deck to the perforated plate or screen can e.g. be over a certain zone, or e.g. via spot connections, e.g. a number of spot weldings.

The fiber based substrate can e.g. be a knitted fabric, a woven fabric or a nonwoven fabric. The burner deck can also be made out of sintered fibrous material.

In an embodiment of the invention, the perforated plate supporting the burner deck is made out of stainless steel. In another embodiment of the invention, the screen supporting the burner deck is a woven metal wire screen. The perforated plate supporting the burner deck can also be an expanded metal plate (preferably made out of stainless steel).

Experiments have shown that a thermocouple of the premix gas burner according to the invention provided reliable and reproducible temperature measurements.

The premix gas burner can be of the flat type, or having a burner deck curved in one direction, or can be cylindrical, conical or frustoconical or be of any shape as is known in the art. Preferably, the contact wires are connected in a central zone of the burner deck.

In a specific embodiment of the invention, the contact wires of the thermocouple are in a housing. In a more specific embodiment, the housing is comprising ceramic material.

In order to obtain appropriate temperature measurements, it is possible to modify locally at or around the position of the thermocouples the porosity of the fiber based substrate and/or of the perforated plate or screen that is supporting the fiber based substrates. Examples are locally modified perforation patterns in the perforated plate, local holes in the fiber based substrate or locally different thickness of the fiber based substrate, locally a different structure of the fiber based substrate.

In a preferred embodiment of the invention, a hole is present in the fiber based substrate around where the contact wires of a thermocouple are fixed directly or indirectly to the burner deck. The at least partly (direct or indirect) connection of the fiber based substrate to the perforated plate or the screen is at least at the edges of the hole in the fiber based substrate. In a preferred execution of the invention, the hole in the fiber based burner substrate is within a diameter range of 5 to 55 mm, preferably within a diameter range of 5 to 24 mm, of the projection of the centerpoint of the thermocouple (s) onto the burner deck. The hole can be circular, oval, rectangular, square or have another shape. Preferably, if a perforated plate is used to support the fiber based substrate, there are no holes present in the perforated plate at the location of the hole in the fiber based substrate, with the possible exception of holes (e.g. through holes) in which the contact wires can be fixed onto the perforated plate.

The presence of the hole in the fiber based substrate has shown to increase the speed of reaction of the thermocouple to changing conditions. It results also in a higher measured temperature, which means that the resolution of the measurement system is improved. The at least partial fixation of the fiber based substrate at the edges of the hole has been proven to be a safety feature to prevent the flame from going back, under the fiber based substrate and into the premixing chamber. This is known as a flash back.

In another embodiment of the invention; a hole is present in the perforated plate or the screen that is supporting the fiber based substrate around where the contact wires are indirectly fixed to the burner deck. The contact wires of a thermocouple are fixed onto an additional member. The additional member is fixed to the burner deck, creating the indirect fixation of the contact wires of a thermocouple onto the burner deck. In a specific embodiment, the additional member can be a ceramic housing in which the contact wires of the thermocouple are fixed. In a preferred execution of the invention, the hole in the perforated plate or the screen that is supporting the fiber based substrate around where the contact wires are indirectly fixed to the burner deck, is within a diameter range of 5 to 55 mm, preferably within a diameter range of 5 to 24 mm, of the projection of the centerpoint of the thermocouple onto the burner deck. The hole can be circular, oval, rectangular, square or have another shape.

In a specific embodiment the additional member is a metal plate structure or an additional plate. The additional plate can be circular, square, rectangular, polygonal or oval. Preferably, the vertical projection of the additional member (e.g. a metal plate structure or additional plate) onto the surface of the burner deck falls within a diameter range of 5 to 60 mm, preferably within a diameter range of 10 to 30 mm, of the projection of the centerpoint of the thermocouple onto the burner deck. It can have a bent shape, so as to form the shape and curvature of the burner deck it is fixed onto. Preferably, the additional metal plate structure is heat resistant and has preferably a low thermal conductivity. In a specific execution of the invention, the additional metal plate structure is comprising stainless steel; in an even more specific execution, it is made out of stainless steel. Even more preferred, the metal plate is made out of the same material as the perforated plate or screen that is supporting the fiber based substrate. In one embodiment of the invention, the additional metal plate structure is having the same thickness as the perforated plate or the screen that is supporting the fiber based burner substrate. Preferably, the additional metal plate structure has a thickness between 0.1 and 1.5 mm. More preferably between 0.1 and 0.75 mm. Most preferably, the additional metal plate structure is as thin as possible. In a specific execution, the additional metal plate structure can be fixed at the side of the burner deck where the fiber based substrate is located. In an alternative execution of the invention, the additional metal plate structure can be fixed in between the fiber based substrate and the perforated plate or the screen supporting the fiber based substrate. In another alternative execution, the additional metal plate structure can be fixed at the side of the burner deck where said perforated plate or said screen is located; it is a specific benefit of this execution that a faster response of the temperature measurement to changes in the temperature of the burner deck is obtained. Preferably, the additional metal plate structure has neither perforations nor holes in it, with the possible exception of holes (that can be through holes) for the fixation of the thermocouples.

In yet an alternative embodiment, the additional member is a head, the head is having a front side where the temperature is measured, and a rear side opposite the front side. The contact wires can be connected via or to the rear side of the head. The head comprises a portion connectable to the perforated plate or to the screen supporting the fiber based substrate, so that the contact wires are connectable to the premix gas burner by means of the head. In a specific execution of this embodiment, the head is comprising metal material. In a more preferred execution, the head is comprising stainless steel. In a more preferred embodiment, the head is made out of material having the same thermal expansion coefficient of the perforated plate or of the screen that is supporting the fiber based substrate. More preferred, the head is made out of the same material as the perforated plate or the screen supporting the fiber based substrate.

In a specific execution of the invention, the head is clamped into a hole in the fiber based substrate and into a hole of the perforated plate or of the screen supporting the fiber based burner substrate. It is a specific benefit of this embodiment that a fast and easy installation can be made of the temperature measurement system onto the burner deck.

As an example, the contact wires that form the thermocouple are connected to a metal connecting piece. The metal connecting piece is clicked into a hole in the supporting perforated plate or screen. The fiber based substrate is connected to the supporting perforated plate or screen at the edges of the hole made into it where the thermocouple device is going through the supporting perforated plate or screen and the fiber based substrate. The connection of the fiber based substrate can be done via spot welding, via welding over the circumference of the hole, or via clamping by means of the metal connecting piece. The benefit of this embodiment is a rapid installation of the temperature measurement system onto the burner deck.

In yet another embodiment of the first aspect of the invention, the at least two contact wires of a thermocouple are connected into through holes that fit the size of the contact wires. The through holes can be provided in the perforated plate or in the screen that is supporting the fiber based substrate or in the additional member or in the additional metal plate structure. This embodiment of the invention provides a faster reaction of the thermocouple measurement to changes of the temperature at the burner deck. A higher temperature is measured when the burner is in operation, and hence the resolution of the measurement system is higher. The response to changes of the temperature of the burner deck is also faster.

In a specific embodiment, at least three contact wires are fixed to the burner deck and used to form thermocouple arrangements. The benefit of an arrangement of at least three contact wires is that a double check of the temperature can be performed. This use can also include a failure check of the thermocouple systems. Furthermore, the temperatures of the different thermocouples can be averaged, in order to reduce the measurement error. A more reliable and more accurate temperature measurement is obtained. In a more preferred embodiment, at least four contact wires are used, which result in a more secure measurement system.

A second aspect of the invention is the use of a gas premix burner according to the first aspect of the invention. Examples of such use include heating systems and water heaters, e.g. instantaneous water heating systems.

A third aspect of the invention is a burner control system comprising the premix gas burner and the thermocouple according to the first aspect of the invention. The benefit is that an efficient and effective temperature value is available and used in the control system, ensuring a reliable control of the premix gas burner.

A fourth aspect of the invention is the use of a burner control system according to the third aspect of the invention. Examples of such use is in heating systems or in water heaters, e.g. in instantaneous water heaters.

BRIEF DESCRIPTION OF THE DRAWINGS

Example embodiments of the invention are described hereinafter with reference to the accompanying drawings.

DETAILED DESCRIPTION OF THE INVENTION

A number of examples to carry out the invention will be described.

Figure 1:
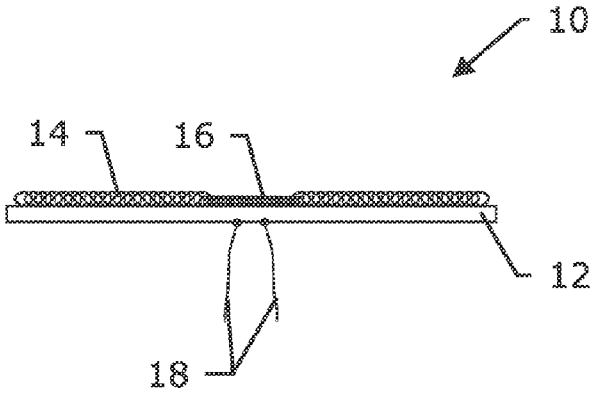
FIG. 1 shows an example of carrying out the invention in which the fiber based substrate is locally connected to the supporting plate or screen.

FIG. 1 shows a first example of carrying out the invention. A burner deck 10 is shown which is comprising a perforated plate 12 supporting a fiber based substrate 14. The fiber based substrate 14 is connected to the perforated plate or screen 12 in the region 16 where the contact wires 18 of the thermocouple are fixed to the burner deck. The connection of the fiber based burner deck to the perforated plate can have as a consequence that the fiber based substrate is having a lower thickness where the fiber based substrate is connected to the perforated plate, as shown in FIG. 1.

It is possible to modify the porosity of the perforated plate or the fiber based substrate 14 locally at or around where the contact wires of the thermocouple are fixed to the burner deck. For instance (but not shown in FIG. 1), it is possible to make additional perforations, or to make larger perforations in the perforated plate around where the contact wires of the thermocouple are fixed to the burner deck. Such additional perforations can e.g. be made within a circular section e.g. with a diameter of between 5-70 mm, preferably with a diameter of 5-55 mm, more preferably with a diameter of 5 to 30 mm of the projection of the centerpoint of the thermocouple(s) onto the burner deck. The benefit of the additional perforations in the perforated plate is an improved signal measured via the thermocouple(s).

Figure 2:
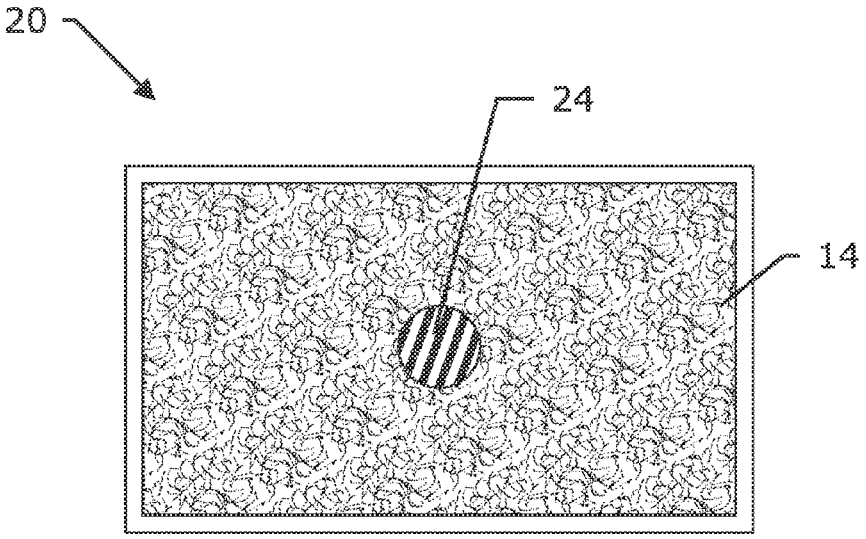
FIGS. 2, 3 and 4 show examples of the way the connections of the fiber based substrate to the supporting plate or screen can be made in examples according to FIG. 1.

FIG. 2 shows a top view 20 of a premix gas burner according to the invention. The fiber based substrate 14 is supported by a perforated plate or screen (not shown on the figure) and connected to the perforated plate or screen over an area 24, where the contact wires of the thermocouple are fixed to the burner deck. The contact wires of the thermocouple are not shown on the figure, they are fixed to the bottom of the perforated plate or screen. In an alternative embodiment (not shown in the figure), the contact wires of the thermocouple are fixed into through holes of the plate.

Figure 3:
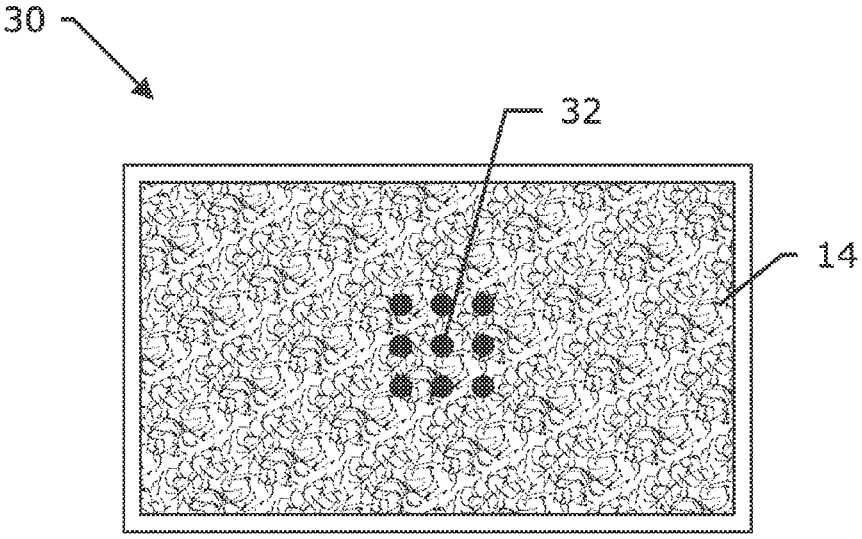

FIG. 3 shows an alternative embodiment. A top view 30 of a premix gas burner according to the invention is shown. The fiber based substrate 12 is supported by a perforated plate or screen (not shown on the figure) and connected to the perforated plate or screen over a number of spot connections 32, in the region where the contact wires of the thermocouple are fixed to the burner deck. The contact wires of the thermocouple are not shown on the figure, they are fixed to the bottom of the perforated plate or screen. In an alternative embodiment (not shown in the figure), the contact wires of the thermocouple are fixed into through holes of the plate. The spot connections can e.g. be spot weldings.

Figure 4:
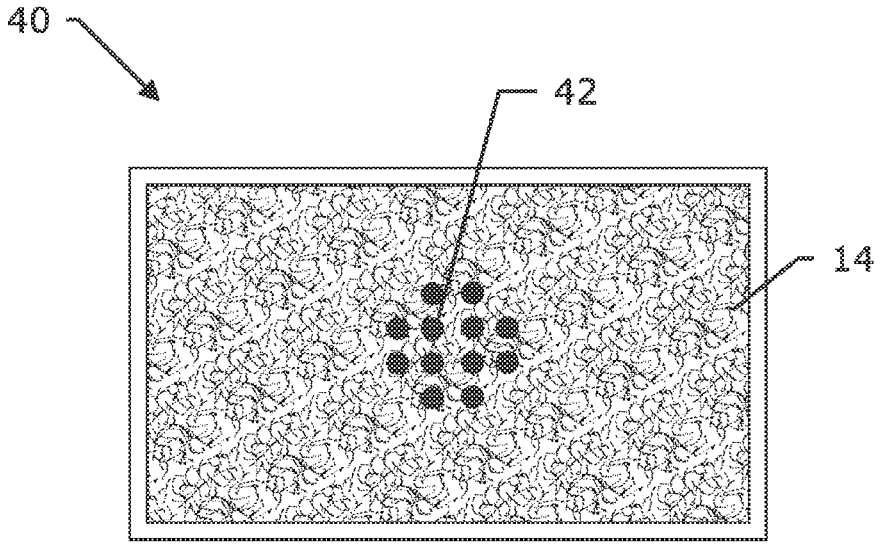

FIG. 4 shows an alternative embodiment. A top view 40 of a premix gas burner according to the invention is shown. The fiber based substrate 12 is supported by a perforated plate or screen (not shown on the figure) and connected to the perforated plate or screen over a number of spot connections 42. The spot connections are in one or more circular arrangements in the region where the contact wires of the thermocouple are fixed to the burner deck. The contact wires of the thermocouple are not shown on the figure, they are fixed to the bottom of the perforated plate or screen. In an alternative embodiment (not shown in the figure), the contact wires of the thermocouple are fixed into through holes of the plate. The spot connections can e.g. be spot weldings.

Figure 5:
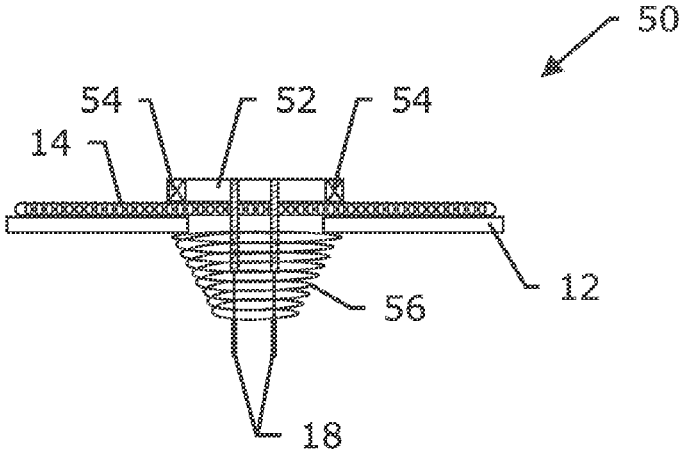
FIG. 5 shows an example of an embodiment in which an additional plate structure is fitted onto the burner deck.

FIG. 5 shows a cross sectional view 50 of an alternative embodiment of the invention. At least two contact wires 18 are fixed to an additional plate 52. The additional plate is connected (54 shows the connections) to the fiber based substrate 14. The connections of the additional plate 52 onto the fiber based substrate create a direct or indirect fixation of the fiber based substrate 14 onto its supporting perforated plate or screen 12. An example is that the welding of the additional plate 52 onto the fiber based structure 14 also creates weldings of the fiber based structure 14 onto its supporting plate or screen 12. An alternative possibility is where a spring 56 is present that is pressing the additional plate 52 onto the fiber based substrate 14 and the latter onto the perforated plate or screen 12, this way, the spring is securing the whole set up of thermocouple, additional plate, fiber based substrate and perforated plate or screen. In an alternative to this embodiment, a hole is present in the fiber based substrate at the location where a hole is present in the perforated plate or screen.

Figure 6:
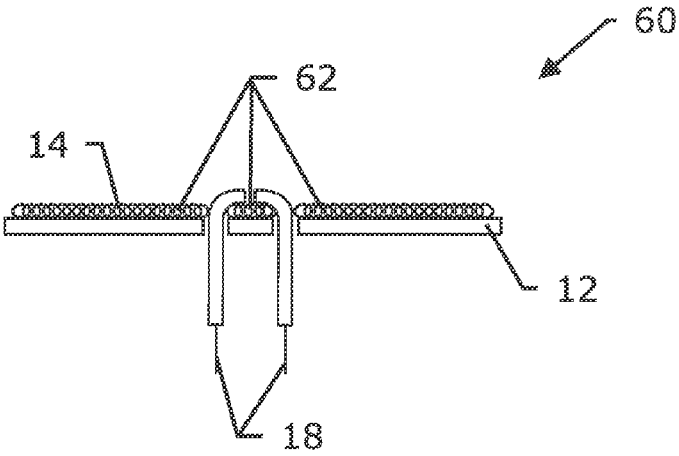
FIGS. 6, 7 and 8 show exemplary embodiments in which a hole is made in the fiber based substrate.

FIG. 6 shows a cross sectional view 60 of an alternative execution of the invention. The contact wires 18 are lead through openings in the perforated plate or screen 12 and through holes in the fiber based substrate 14. And connected to each other at the top of the fiber based substrate 14 to form a thermocouple arrangement. The fiber based substrate 14 is fixed to the supporting plate or screen 12 at positions 62.

Figure 7:
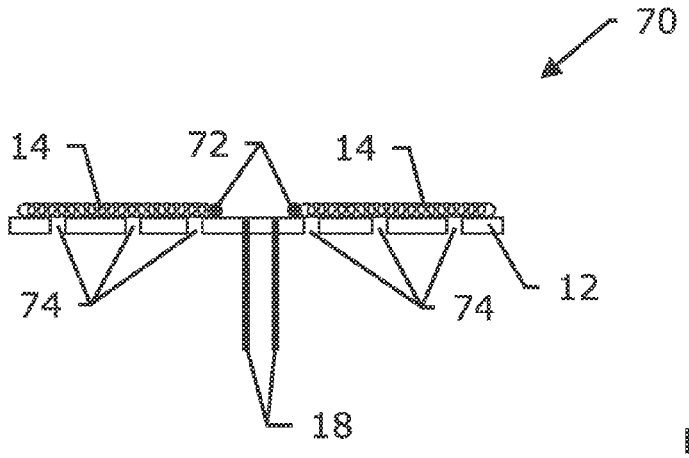

FIG. 7 shows a cross sectional view 70 of yet an alternative execution of the invention. The contact wires 18 are fixed into through holes of the perforated plate 12 that is supporting the fiber based substrate 14. A hole is made in the fiber based substrate in the region where the contact wires 18 of the thermocouple are fixed to the supporting plate 12. The fiber based substrate is fixed (at positions 72) to the supporting perforated plate at the edges of the hole made in the fiber based substrate 14. The fixation of the fiber based substrate to the supporting plate can be along the full circumference of the hole, or via spot or dash shaped fixations, e.g. spot weldings, or e.g. weldings having the shape of crosses. The perforated plate 12 has perforations 74 for the passage of the premixed combustion gas, but under the hole in the fiber based substrate, no perforations are present in the perforated plate (except for the holes into which the contact wires are fixed).

Figure 8:
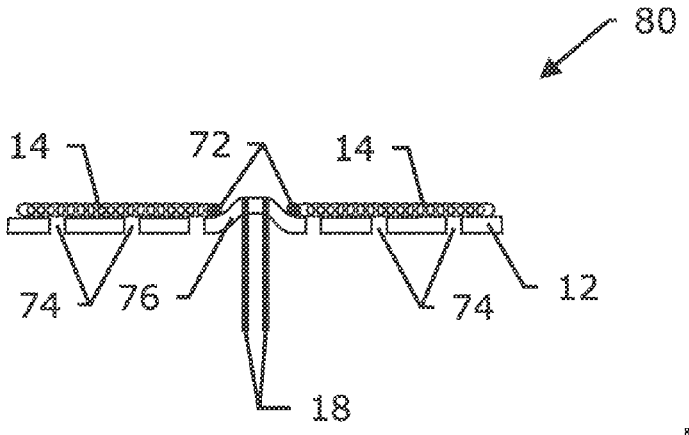

FIG. 8 shows a cross sectional view 80 of an alternative embodiment. The contact wires 18 are fixed into through holes of the perforated plate 12 that is supporting the fiber based substrate 14. A hole is made in the fiber based substrate in the region where the contact wires 18 of the thermocouple are fixed to the supporting plate 12. The fiber based substrate is fixed (at positions 72) to the supporting perforated plate at the edges of the hole made in the supporting plate 12. The fixation of the fiber based substrate to the supporting plate can be along the full circumference of the hole, or via spot or dash shaped fixations, e.g. spot weldings. The perforated plate 12 has perforations 74 for the passage of the premixed combustion gas, but under the hole in the fiber based substrate, no perforations are present in the perforated plate (except for the holes into which the contact wires are fixed). The perforated plate has a bulb shape where the contact wires are connected to the perforated plate. The bulb shape can be such that the thermocouple is measuring the temperature of the burner deck at the height of the fiber based burner deck.

Figure 9:
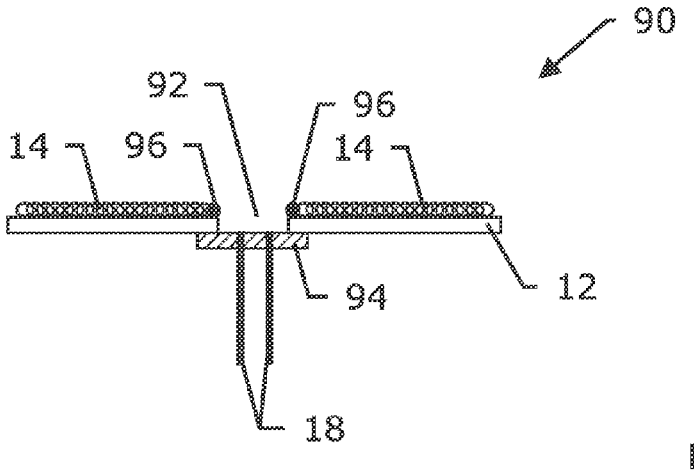
FIGS. 9, 10 and 11 show embodiments where holes are made in the fiber based substrate and in the perforated plate or screen and an additional metal plate structure is used onto which the contact wires are fitted.

FIG. 9 shows a cross sectional view 90 of yet an alternative embodiment of the invention. A hole 92 is made in the perforated plate or screen 12 and in the fiber based burner deck 14. An additional plate 94 is connected to the perforated plate or screen 12. The contact wires 18 that form the thermocouple are connected to the additional plate 94, e.g. connected into through holes in the additional plate 94. The fiber based substrate is connected as indicated in 96 at the edges of the hole 92 to the perforated plate or screen.

Figure 10:
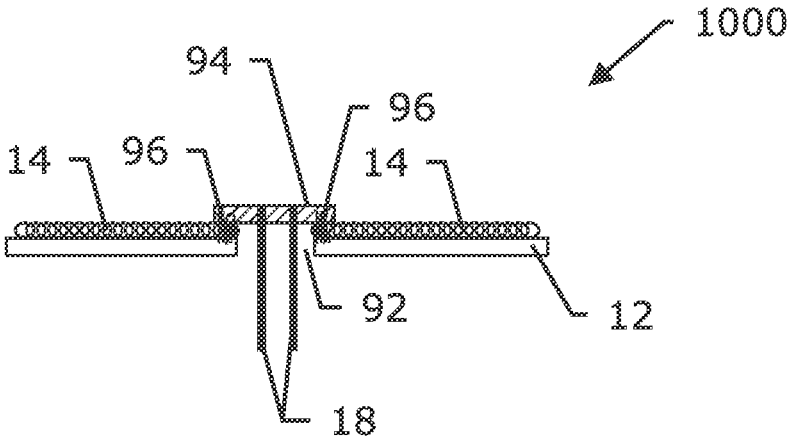

FIG. 10 shows an alternative to the solution of FIG. 9. Cross sectional view 1000 shows that a hole 92 is made in the perforated plate or screen 12 and in the fiber based burner deck 14 and the fiber based burner deck 14 is fixed to the perforated plate or screen 12. An additional plate 94 is connected onto the fiber based substrate. The contact wires 18 that form the thermocouple are connected to the additional plate 94, e.g. connected into through holes in the additional plate 94. The connections 96 can e.g. be via welding (e.g. spot welding), in which the welds connecting the additional plate to the fiber based substrate 14 are also connecting the fiber based burner substrate to the perforated plate or screen.

Figure 11:
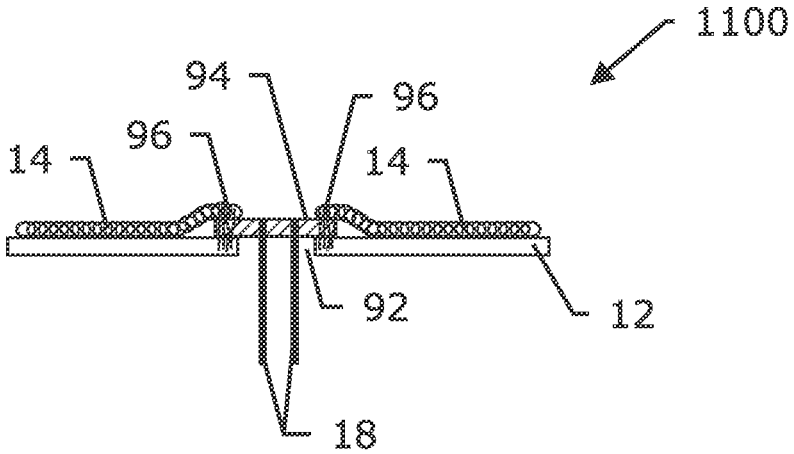

In yet another embodiment as shown in FIG. 11, the additional perforated plate 94 is connected in between the perforated plate or screen 12 and the fiber based substrate 14. Cross sectional view 1100 shows that a hole 92 is made in the perforated plate or screen 12 and in the fiber based burner deck 14. An additional plate 94 is connected onto the perforated plate or screen 12 and onto the fiber based substrate 14. The contact wires 18 that form the thermocouple are connected to the additional plate 94, e.g. connected into through holes in the additional plate 94. The connections 96 can e.g. be via welding (e.g. spot welding).

Figure 12:
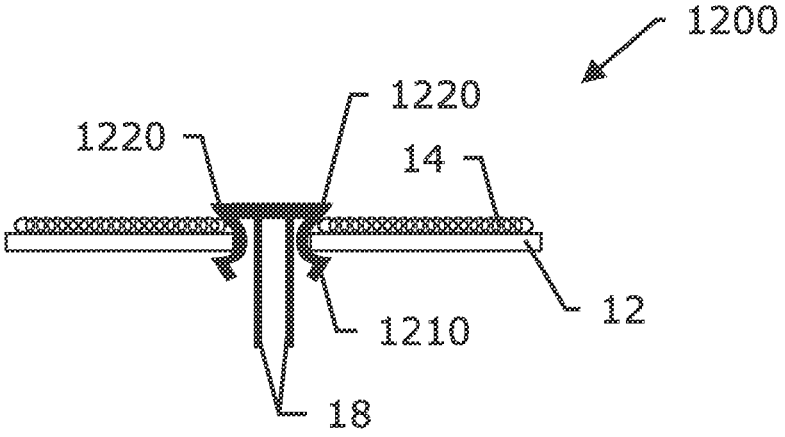
FIGS. 12 and 13 show embodiments in which an additional head is used. The contact wires are attached to the additional head and the additional head is connected to the burner deck.

The cross section 1200 in FIG. 12 shows an embodiment in which an additional head 1210 is used. A hole is made in perforated plate or screen 12 and in the fiber based substrate 14. The additional head 1210 (to which the contact wires 18 are connected) is inserted in the holes in the perforated plate or screen and in the fiber based substrate. In one execution (as shown in FIG. 12) the additional head is clamping at positions 1220 the fiber based substrate 14 onto the perforated plate or screen 12. The additional head can be made out of stainless steel. Preferably, the head is made out of the same stainless steel alloy of the perforated plate or screen, resulting in the same thermal expansion behaviour of the head and of the perforated plate or screen. Alternatively or additionally, the fiber based substrate can be welded to the perforated plate or screen at the edges of the hole; the welding can be done via spot welding or via welding along the circumference of the hole.

Figure 13:
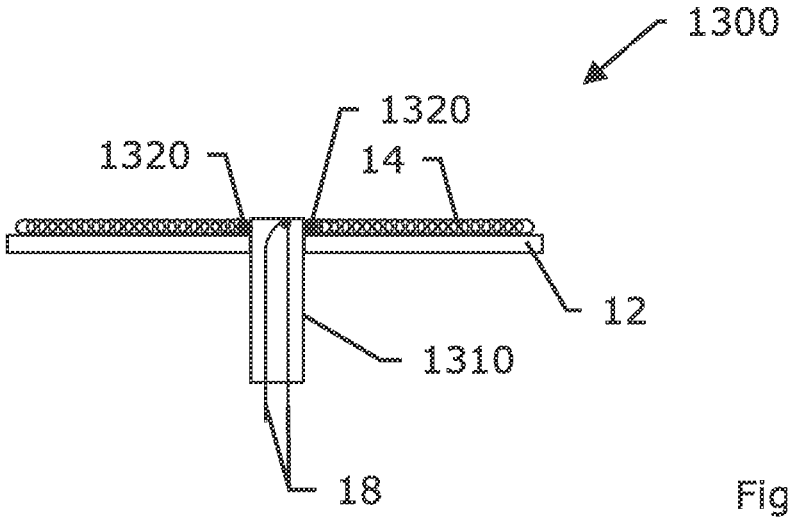

The cross section 1300 in FIG. 13 shows an embodiment in which an additional head 1310 is used. The head can be made out of ceramic material. The head is fixed in a hole made in the perforated plate or screen 12 and in the fiber based substrate 14. The contact wires of the thermocouple are fitted into the head and the thermocouple is formed at the top of said head, measuring the temperature at the burner deck. The fiber based substrate is fixed at positions 1320 onto the perforated plate or screen at the edges of the hole in the fiber based burner deck and perforated plate or screen. The fixations 1320 can e.g. be made via welding, which can be done via spot welding or via welding along the circumference of the hole.

Figure 14:
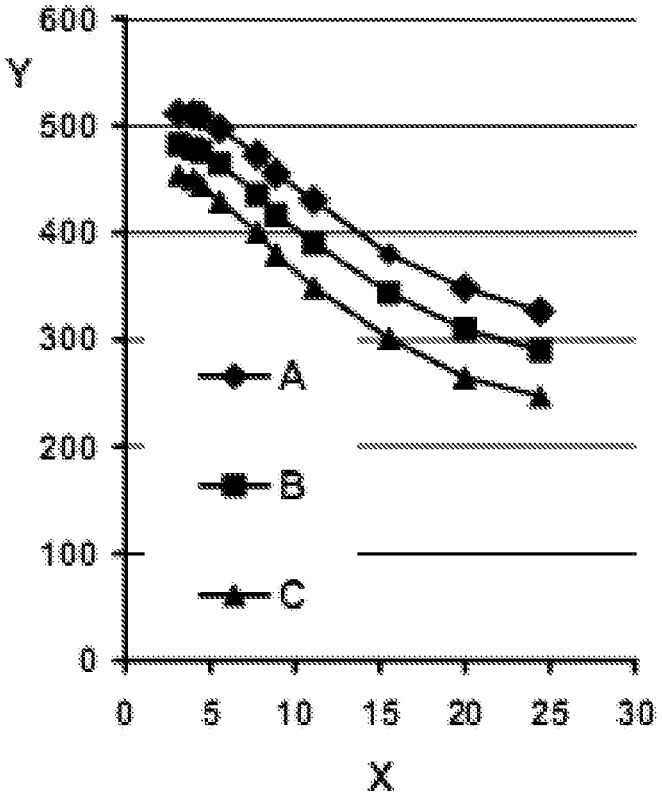
FIG. 14 shows temperature measurements executed with the thermocouple provided on a premix gas premix burner according to the invention.

FIG. 14 shows temperature measurements by the thermocouple on a premix gas premix burner according to the set up as shown in FIG. 10. The X-axis shows the power (in kW) of the burner, the Y-axis is the temperature (in degrees C.) measured with the thermocouple arrangement as in FIG. 10. The experiments have been done with the burner in free air (not integrated into a water heater). The measurements have been performed for three different lambda values (A: lambda equals 1.15; B: lambda equals 1.25 and C: lambda equals 1.35). The experiments show the reliability and repeatability of the temperature measurements obtained with this set up. The test results show a very high coefficient of correlation between the power and the measured temperature values (coefficient of correlation 0.99154 for A; 0.9895 for B and 0.98687 for C).

In one embodiment of the invention, the fiber based burner deck is a metal fiber knitted fabric. In another embodiment, the fiber based burner deck is a metal fiber woven fabric. In another embodiment, the fiber based burner deck is a metal fiber nonwoven fabric. In another embodiment, the burner deck is made out of sintered fibrous material.

In a first embodiment, the metal fibers used for the fiber based substrate, e.g. stainless steel fibers, with a diameter less than 40 micrometers, e.g. less than 25 micrometers, are obtained by a bundle drawing technique. This technique is disclosed e.g. in U.S. Pat. Nos. 2,050,298, 3,277,564 and in 3,394,213. Metal wires are forming the starting material and are covered with a coating such as iron or copper. A bundle of these covered wires is subsequently enveloped in a metal pipe. Thereafter the thus enveloped pipe is reduced in diameter via subsequent wire drawing steps to come to a composite bundle with a smaller diameter. The subsequent wire drawing steps may or may not be alternated with an appropriate heat treatment to allow further drawing. Inside the composite bundle the initial wires have been transformed into thin fibers which are embedded separately in the matrix of the covering material. Such a bundle preferably comprises no more than 2000 fibers, e.g. between 500 and 1500 fibers. Once the desired final diameter has been obtained the covering material can be removed e.g. by solution in an adequate pickling agent or solvent. The final result is the naked fiber bundle.

In a second embodiment, metal fibers for the burner deck, such as stainless steel fibers are manufactured in a cost effective way by machining a thin plate material. Such a process is disclosed e.g. in U.S. Pat. No. 4,930,199. A strip of a thin metal plate is the starting material. This strip is wound around the cylindrical outer surface of a rotatably supported main shaft a number of times and is fixed thereto. The main shaft is rotated at constant speed in a direction opposite to that in which the plate material is wound. A cutter having an edge line expending perpendicularly to the axis of the main shaft is fed at constant speed. The cutter has a specific face angle parallel to the axis of the main shaft. The end surface of the plate material is cut by means of the cutter.

Elements of different embodiments and/or elements of different examples of the invention can be combined within the scope of the invention.

The invention claimed is:

1. A premix gas burner for operation in blue flame mode, comprising a burner deck, the burner deck comprises a fiber based substrate and a perforated plate out of stainless steel or a woven metal wire screen supporting the fiber based burner substrate;

and the burner deck further comprises at least two contact wires forming a thermocouple, the contact wires being directly or indirectly fixed to the burner deck to measure a temperature of the burner deck when the premix gas burner is in operation, wherein the fiber based substrate is a knitted fabric or a woven fabric, wherein the fiber based substrate is locally at least partly connected directly or indirectly to the perforated plate out of stainless steel or the woven metal wire screen in a region where the contact wires of the thermocouple are directly or indirectly fixed to the burner deck, wherein the fiber based substrate is fixed to the perforated plate out of stainless steel or to the woven metal wire screen within an area defined by a circle with diameter of 50 mm around a projection of the centerpoint of contact wire connections to the burner deck.

2. The premix gas burner as in claim 1, wherein a hole is present in the fiber based substrate around where the contact wires of the thermocouple are fixed directly or indirectly to the burner deck, and wherein the at least partly connection of the fiber based substrate to the perforated plate or the screen is at least at the edges of the hole in the fiber based substrate.

3. The premix gas burner as in claim 1, wherein the burner further comprises an additional member, the additional member being fixed to the burner deck and wherein the contact wires of the thermocouple are fixed onto the additional member, creating the indirect fixation of the contact wires of the thermocouple onto the burner deck; and wherein a hole is present in the perforated plate or the screen that is supporting the fiber based substrate around where the contact wires are indirectly fixed to the burner deck.

4. The premix gas burner as in claim 3, wherein the additional member is a metal plate structure or metal plate.

5. The premix gas burner as in claim 3, wherein the additional member is a metal plate structure and wherein the additional metal plate structure is fixed at the side of the burner deck where the perforated plate or the screen is located.

6. The premix gas burner as in claim 3, wherein the additional member is a metal plate structure and wherein the additional metal plate structure is fixed at the side of the burner deck where the fiber based substrate is located.

7. The premix gas burner as in claim 3, wherein the additional member is a metal plate structure and wherein the additional metal plate structure is fixed in between the fiber based substrate and the perforated plate or the screen supporting the fiber based substrate.

8. The premix gas burner as in claim 3, wherein the additional member is a head, the head has a front side where the temperature is measured, and a rear side opposite the front side; the contact wires are connected to the rear side of the head; wherein the head comprises a portion connectable to the perforated plate or to the screen supporting the fiber based substrate, configured that the contact wires are connectable to the premix gas burner by means of the head.

9. The premix gas burner as in claim 8, wherein the head is clamped into a hole in the fiber based substrate and into the hole of the perforated plate or of the screen supporting the fiber based burner substrate.

10. The premix gas burner as in claim 1, wherein the at least two contact wires of the thermocouple are connected into through holes that fit the size of the contact wires, the through holes are provided in the perforated plate or in the screen that supports the fiber based substrate or in the additional member or in the additional metal plate structure.

11. The premix gas burner as in claim 1, wherein at least three contact wires are fixed to the burner deck and used to form thermocouple arrangements.

12. A burner control system comprising the gas premix burner and the thermocouple as described in claim 1.

13. A heating apparatus comprising the burner control system as in claim 12.

* * * * *